United States Patent [19]

Middleton et al.

[11] 4,117,781

[45] Oct. 3, 1978

[54] UTILITY DESK

[75] Inventors: Charles A. Middleton; Trudy B. Middleton, both of Phoenix, Ariz.

[73] Assignee: TCM Corporation, Phoenix, Ariz.

[21] Appl. No.: 812,565

[22] Filed: Jul. 5, 1977

[51] Int. Cl.[2] ..... A47B 85/00

[52] U.S. Cl. ..... 108/11; 108/19; 248/451; 248/445; 248/457

[58] Field of Search ..... 108/11, 49, 43, 12, 108/19; 248/441 R, 445, 451, 455, 457; 5/332

[56] References Cited

U.S. PATENT DOCUMENTS

| | | | |
|---|---|---|---|
| 368,677 | 8/1887 | Maxwell | 248/457 |
| 1,924,945 | 8/1933 | Klotz | 108/19 X |
| 2,436,273 | 2/1948 | Solomon | 248/441 X |
| 2,807,908 | 10/1957 | Lykes | 248/451 |
| 3,491,705 | 1/1970 | Blanke | 5/332 X |

FOREIGN PATENT DOCUMENTS

| | | | |
|---|---|---|---|
| 185,103 | 9/1936 | Switzerland | 108/43 |

*Primary Examiner*—Roy D. Frazier
*Assistant Examiner*—Peter A. Aschenbrenner
*Attorney, Agent, or Firm*—Martin L. Stoneman

[57] ABSTRACT

A portable utility desk for bed-patient and other uses including a flat, rectangular surface having a semicircular notch on one side thereof for adapting to the body of the user and providing for attachment of legs to the surface to be usable in a multiplicity of positions and further providing a book-holder structure for holding a book in stationary position on the flat surface.

3 Claims, 9 Drawing Figures

UTILITY DESK

BACKGROUND OF THE INVENTION

This invention relates to utility desks.

More particularly, the invention concerns a portable utility desk comprising a generally-rectangular, substantially-flat table member with leg supports and book supports adapted to a multiplicity of uses.

In a further aspect, the invention concerns a utility desk especially adapted for use in at least five alternative positions, which five uses may be generally referred to prone reader, normal desk, back support, lap tray, and lounge-position reader.

It has been a problem in the past for people who must remain in a prone position, whether due to illness or otherwise, to avail themselves of a desk or similar support for the purpose of holding a book, letter writing, art work, and many other purposes. Furthermore, in the case of a hospital patient who is bedridden and must remain in a prone position for only a few days or weeks, it has been economically unfeasible either to build something suitable for such temporary use or to attempt to purchase special-use equipment which will no longer be of value when the problem has passed. Historically, each use requiring a "desk-type" function has required a special purpose piece of equipment to adequately satisfy that use.

Examples of areas of use for desk-type functions presently being satisfied with single-purpose equipment include standard desk use in which the user sits in a chair adjacent to the desk; the use of a tray-type flat surface resting on the legs of the user who is sitting up in bed; the use of an easel-type surface by the user sitting up in a bed or otherwise in a lounging position; and the use of an angled back support having sufficient strength and rigidity for use behind the user attempting to support and elevate the head and back in bed.

Futhermore, it is seen that different structures are best adapted for such different uses as hereinabove mentioned. Thus there is a need for a utility desk which is well-adapted to a multiplicity of uses.

In addition, when the use to which a desk-type surface is put requires a deviation from the horizontal, or even inversion, there is often great difficulty in keeping books or other similar items in place on the surface. Also, there is inconvenience, instability, and sometimes pain associated with attempting to rest the edge of a desk-type surface on the user's body rather than on the underlying bed or other support.

It would be highly advantageous, therefore, to provide a portable utility desk which is not only adapted to a multiplicity of uses, but provides also for the solution of the other problems hereinbefore mentioned with respect to the prior art.

SUMMARY OF THE INVENTION

Accordingly, it is the primary object of the present invention to provide an improved utility desk.

Another object of the present invention is the provision of a portable utility desk adapted to a multiplicity of uses, including the uses hereinbefore mentioned in discussing the prior art.

Still another object is to provide a utility desk which may be handled with ease and is economically inexpensive.

Yet another object of the present invention is the provision of a utility desk of the above type which is convenient to use and adapts to the user's body in a stable and easy manner.

Even another object is to provide a utility desk which allows a book to be held in a slanted or inverted position.

Yet still another object of the present invention is the provision of a utility desk of the above type which is efficient in its manner of operation, relatively inexpensive to manufacture, and having a high degree of durability and serviceability.

Briefly, to accomplish the desired objectives of the present invention in accordance with the presently preferred embodiment thereof, there is provided a utility desk having a generally-rectangular, substantially-flat table member having a notch midway along an edge of the table member. A semi-circular notch is preferred. A positionally-adjustable leg member is detachably connected to the table member. A book support member is located on the table member above the notch and includes mechanical means for preventing a book on the table member from sliding or falling. In the preferred embodiment, a pair of longitudinal frame members, each having an L-shaped cross-section, are positioned in opposed relationship on either side of the table member, the opposed edges of the table member abutting the internal angle of the frame members. A pair of transverse book-support bars are located adjacent the table member and between the frame members, above the notch, and the ends of the book-support bars are detachably connected to the frame members. A pair of elastic bands is located around the book-support bars and stretched therebetween for the purpose of holding the pages of a book open. This construction permits the table member to be reversed so as to allow the legs to extend in either the same direction or opposed to the side of the table member containing the book-support bars.

BRIEF DESCRIPTION OF THE DRAWINGS

Further and more specific objects and advantages of the present invention will become readily apparent to those skilled in the art from the following detailed description thereof taken in connection with the drawings, in which.

DETAILED DESCRIPTION OF THE PREFERRED EMBODIMENT

Figure 1:
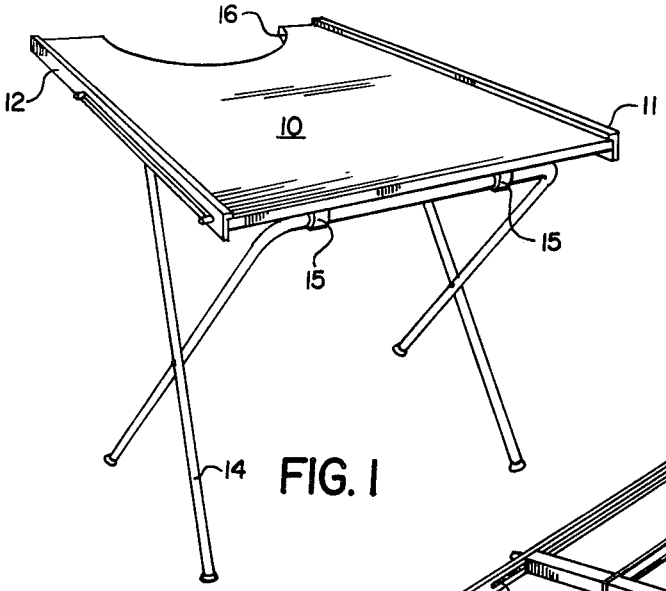
FIG. 1 is an artistic view in perspective of the preferred embodiment of the utility desk of the present invention, shown in position for use as a standard desk.

Turning now to the drawings, in which the reference numerals indicate corresponding elements throughout the several views, FIGS. 1, 2, 3 and 4 illustrate the construction of the presently preferred utility desk. Table member 10 (which is rectangular and flat) is positioned between first frame member 11 and second frame member 12 with opposed edges of table member 10 abutting the internal angle of the L-shaped cross-section of frame members 11 and 12. Leg members 14 are detachably connected to table member 10 by leg support connections 15, preferably friction clamps, as illustrated, of a type well-known in the art. A substantially semi-circular notch 16, as shown, is situated midway along an edge of table member 10. First book-support bar 17 and second book-support bar 18 are located transverse to frame members 11 and 12, adjacent to table member 10 above notch 16 and between frame members 11 and 12. Book-support bars 17 and 18, at the ends thereof, are mechanically detachably connected to frame members 11 and 12. Elastic bands 19, as shown, are located around book-support bars 17 and 18 and stretched therebetween. Slots 20 are longitudinally located in frame members 11 and 12 for the purpose of securing book-support bars 17 and 18 to frame members 11 and 12. This slot construction permits the user to positionally adjust the location of the book supports as desired. Securing screws 21 extend from the ends of book-support bars 17 and 18 and pass through slots 20. Connectors 13, in a well-known manner, screw onto securing screws 21 to firmly, but detachably, connect the book-support bars 17 and 18 to frame members 11 and 12.

Figure 5:
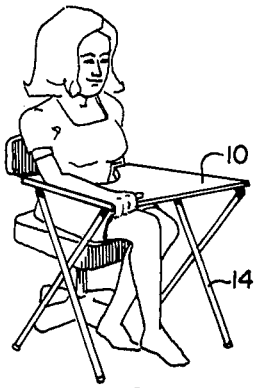
FIG. 5 is a pictorial view for purposes of illustration showing the use of the utility desk of the present invention as a standard desk.

With particular reference to FIG. 1, showing the use of the utility desk of the present invention as a standard desk, table member 10 is located between frame members 11 and 12, as shown, so that the bottom side of table member 10 has attached thereto the leg-support connections 15. The utility desk of the present invention is easily assembled in this configuration by putting the various parts together as shown and applying and tightening the connectors 13. Leg members 14 are then snapped into place on leg-support connections 15 to provide the final structure. As well illustrated in FIG. 5, notch 16 allows the user full access to the desk, the table member fitting around the body of the user, and it is seen that the table member 10 may be, for comfort and convenience, easily used as an armrest.

Figure 2:
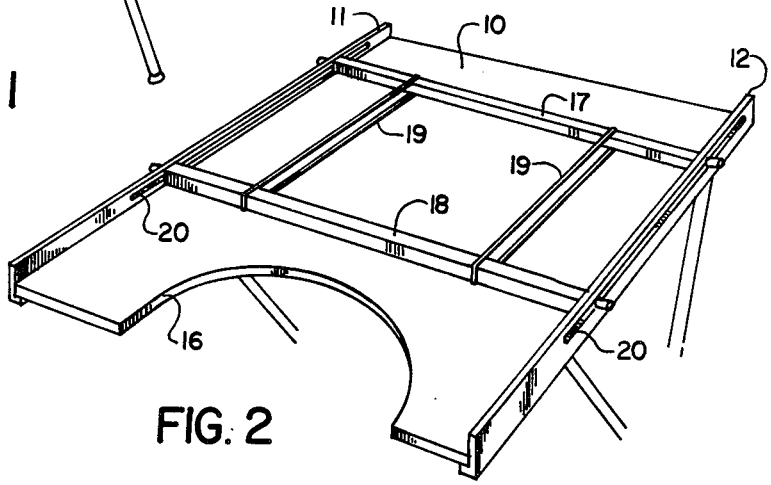
FIG. 2 is a perspective view of the top of the utility desk of the present invention showing the book-support member of the present invention on top of the table member.
Figure 4:
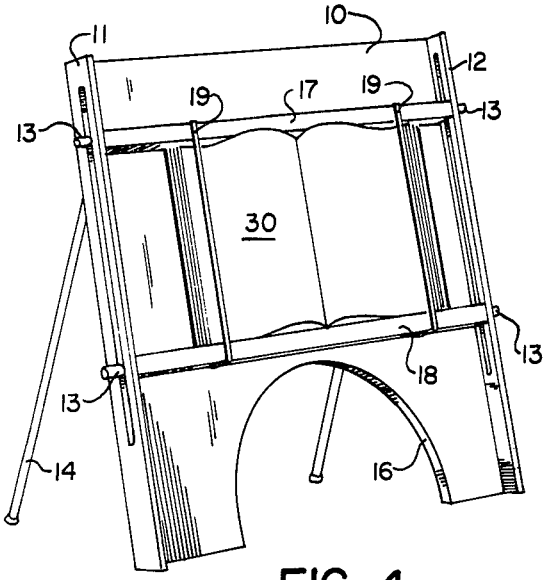
FIG. 4 is a perspective view of the utility desk of the present invention in slanted position for reading (shown with a book inserted and with elastic bands holding the pages open)
Figure 6:
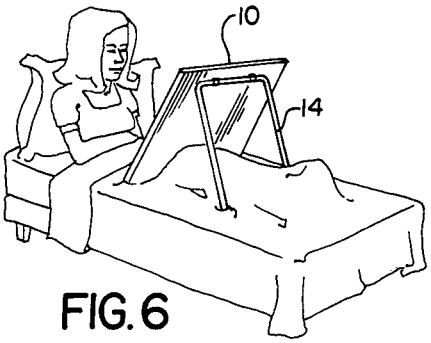
FIG. 6 is a pictorial view for purposes of illustration showing how the utility desk of the present invention may be used for holding a book or similar purpose, while the user is sitting or lounging in bed.

With particular reference to FIG. 2, the utility desk of the present invention is specifically illustrated for the use shown by the user of FIG. 6. Compared to the use of FIG. 1, table member 10 is first inverted, and then the assembly, including table member 10 and frame members 11 and 12, is again inverted. Thus, leg-support connections 15, as illustrated, are located on the other side of table member 10 from the book support bars 17 and 18. The book-support member of the present invention, including book-support bars 17 and 18 and elastic bands 19, is assembled so that such members are located on the upper side of table member 10. The assembly illustrated by FIG. 2, as is seen, may be used as a sitting or lounging reader, for example, as clearly shown in FIG. 6. FIG. 4 illustrates even more clearly this discussed use and further illustrates a book 30 in place between book-support bars 17 and 18 with the pages of book 30 being held at the desired position by elastic bands 19, preferably rubber bands. It is seen that notch 16 will comfortably fit around the user for the ease of the user in using the utility desk of the present invention in this manner.

For maximum benefit and ease of use, it is highly preferred that the radius of the preferred semi-circular notch of the present invention be more than 6 inches and less than 10 inches. These dimensions provide optimal benefit and comfort to an average user.

Figure 3:
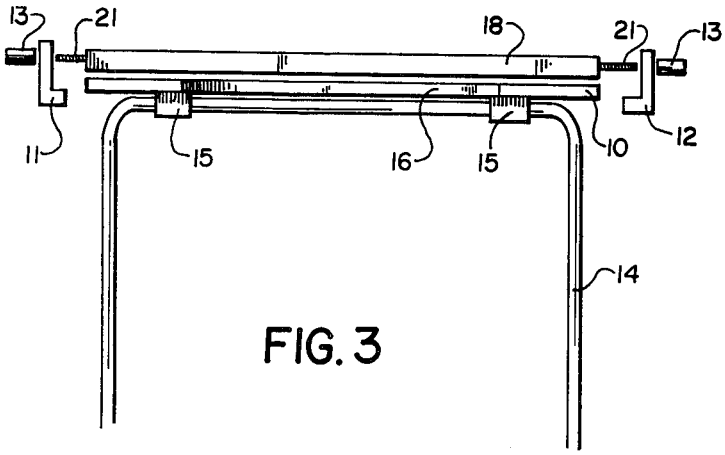
FIG. 3 is a front view of the illustrated preferred embodiment of FIG. 2 with parts exploded.

FIG. 3 further assists in illustrating the method of assembly and disassembly of the various parts of the utility desk of the present invention for its multiplicity of uses, specifically showing, in an exploded view, the assembly of the table member 10, frame members 11 and 12, book-support bars 17 and 18 including securing screws 21, connectors 13, and even the detachable connection of leg members 14 to leg-support connections 15, which are attached to table member 10.

Figure 8:
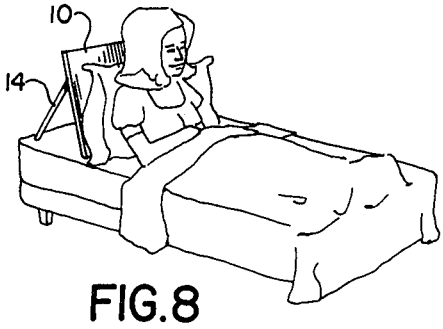
FIG. 8 is a further pictorial view for illustrative purposes of the utility desk of the present invention illustrating its use as a back rest.

In the use of the utility desk of the present invention as a back support, as shown in FIG. 8, the book-support member need not be assembled as the table member 10 and leg members 14 suffice to provide the desired backrest.

Figure 7:
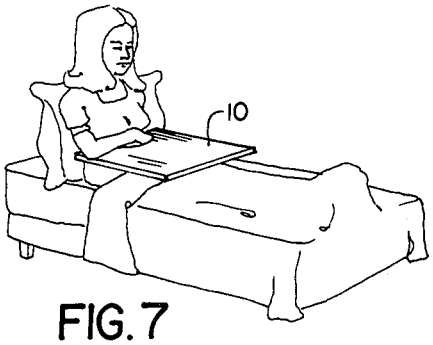
FIG. 7 is yet another pictorial view for illustrative purposes showing how the utility desk of the present invention may be used as a lap table by a user sitting up in bed.

As is clearly shown from FIG. 7, the leg members 14 are not necessary for the use of the present invention as a lap tray, and the book-support member parts will most often not be desired for such use.

Figure 9:
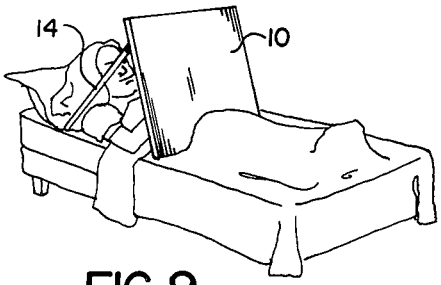
FIG. 9 is yet another pictorial view for illustrative purposes showing how the utility desk of the present invention may be used for reading while the user is lying in bed.

For the use of the utility desk of the present invention as a prone reader, which use is clearly illustrated by FIG. 9 hereof, the book-support member is assembled on the same side of table member 10 which includes leg-support connections 15. Thus, leg members 14 support the utility desk of the present invention in position, preferably one leg member 14 around either side of the user, and the utility desk is stabilized by the location of notch 16 around the body of the user. It is preferred that leg members 14 have tips of non-slip material, such as rubber, for more stability. As has been described, the use of elastic bands 19 for a user reading a book in this position will be most necessary, in combination with the support of book-support bars 17 and 18, in keeping a book 30 from slipping or falling or its pages from moving. It is particularly pointed out that the elastic bands 19 allow the user to turn pages, placing pages under the elastic bands 19 as desired.

It is seen that the utility desk of the present invention may be utilized in a multiplicity of positions by assembling the parts thereof as desired for each use and using the same as shown herein. Even as inexperienced user may assemble and disassemble the utility desk of the present invention with ease and may transport the utility desk of the present invention in a highly portable manner. It is now further seen that the efficient and compact utility desk of the present invention is simple in construction and design and yet easily adaptable to its mentioned uses.

Various changes in the device herein shown for the purpose of illustration will readily occur to persons skilled in the art. Such modifications and variations, while not specifically denoted in the foregoing detailed description of the preferred embodiment, do not deviate from the teachings of the present invention and are intended to be included in the spirit and scope thereof, and the scope of the present invention is intended to be limited only by a fair interpretation of the following claims.

We claim:

1. A portable utility desk, usable in a multiplicity of positions, including:

(a) a generally-rectangular, substantially-flat table member having a notch midway along an edge of said table member;

(b) a positionally adjustable leg member;

(c) first mechanical means for detachably connecting said leg member to said table member;

(d) a book support member on said table member above said notch, said book-support member including second mechanical means for preventing a book on said table member from sliding or falling;

(e) third mechanical means for preventing the pages of a book on said table from turning;

(f) a first and second longitudinal frame member, each said frame member having an L-shaped cross-section;

(g) said table member having first and second opposed edges approximately the length of said first and second frame members;

(h) said first edge abutting the internal angle of said first frame member and said second edge abutting the internal angle of said second frame member;

(i) a third edge of said table member having said notch situated midway along said third edge;

(j) a first and second transverse book support bar between said frame members and adjacent said table member above said notch, and mechanical connector means for detachably connecting the ends of said book support bars to said frame members; and (k) a pair of elastic bands around said book support bars and stretched therebetween.

2. The utility desk of claim 1 wherein said notch is substantially semi-circular.

3. The utility desk of claim 2 wherein said notch has a radius of more than 6 inches and less than 10 inches.

* * * * *